United States Patent [19]

Cox

[11] Patent Number: 4,526,697

[45] Date of Patent: Jul. 2, 1985

[54] IMPROVEMENTS IN THE PREPARATION OF CONCENTRATES FOR HIGH WATER BASED HYDRAULIC FLUIDS

[75] Inventor: Paul V. Cox, Bracknell, United Kingdom

[73] Assignee: Castrol Limited, United Kingdom

[21] Appl. No.: 526,079

[22] Filed: Aug. 24, 1983

[30] Foreign Application Priority Data

Aug. 25, 1982 [GB] United Kingdom ..... 8224358

[51] Int. Cl.[3] ..... C10M 1/48; C10M 3/42; C10M 5/24; C10M 1/06

[52] U.S. Cl. ..... 252/75; 252/32.5; 252/32.7 R; 252/33.3; 252/49.3; 252/49.5; 252/77; 252/78.5

[58] Field of Search ..... 252/32.5, 32.7, 49.3, 252/49.5, 75, 77, 78.5, 33.3

[56] References Cited

U.S. PATENT DOCUMENTS

| | | | |
|---|---|---|---|
| 1,992,689 | 2/1935 | Cox | 252/77 |
| 3,222,284 | 12/1965 | Cook | 252/75 |
| 3,532,632 | 10/1970 | Sugarman et al. | 252/75 |
| 4,010,105 | 3/1977 | Holgado | 252/77 |
| 4,118,329 | 10/1978 | Hotten | 252/32.5 |
| 4,136,041 | 1/1979 | Lenack | 252/46.6 |
| 4,151,099 | 4/1979 | Nassry et al. | 252/32.7 E |
| 4,257,902 | 3/1981 | Singer | 252/76 |
| 4,428,860 | 1/1984 | Panek et al. | 252/78.5 |

FOREIGN PATENT DOCUMENTS

| | | |
|---|---|---|
| 0007567 | 2/1980 | European Pat. Off. . |
| 0024848 | 3/1981 | European Pat. Off. . |
| 1006940 | 10/1965 | United Kingdom . |
| 2031908 | 4/1980 | United Kingdom . |
| 2032951 | 5/1980 | United Kingdom . |

*Primary Examiner*—John E. Kittle
*Assistant Examiner*—Mukund J. Shah
*Attorney, Agent, or Firm*—Bacon and Thomas

[57] ABSTRACT

A high water based hydraulic fluid having about 95% water and a concentrate comprising a zincdihydrocarbyldithiophosphate, the reaction product of an alkanolamine, preferably triethanolamine, and a phosphate ester acid of the general formula:

$$[R^4O(R^5O)_x\underset{\underset{O}{\|}}{P}OH]_{(3-n)}$$

where $R^4$ is hydrocarbyl, $R^5$ is alkyl, each n is independently 1 or 2 and x is between 1 and 20, and optionally a polyalkylene glycol of molecular weight between 1000 and 100000.

A method of preparing a concentrate is also disclosed.

17 Claims, No Drawings

IMPROVEMENTS IN THE PREPARATION OF CONCENTRATES FOR HIGH WATER BASED HYDRAULIC FLUIDS

TECHNICAL FIELD

This invention relates to high water based hydraulic fluids and more particularly to a method of preparing a concentrate for such a fluid which in use is diluted with about 95% of water to form a microemulsion.

BACKGROUND ART

The advantages of using such fluids in various applications, and also some disadvantages, have been described in an article in the September/October 1981 Issue of Fluid and Lubricant Ideas starting at page 6. This article mentions the lower cost, better heat transfer characteristics, reduced environmental risk and improved fire resistant properties which high water based fluids exhibit. The use of such fluids also removes the dependency on possibly unreliable mineral oil supplies.

Various patents describe compositions useful in such fluids. See for example United Kingdom published application Nos. 2031908 and 2032951 (Lubrizol), European published applications Nos. 0007567 (Theunissen) and 0024848 (Mobil) and U.S. Pat. Nos. 4,257,902 (Singer), 4,138,346 (BASF) and 4,151,099 (BASF).

It is an object of this invention to provide a method of preparing a concentrate for a high water based hydraulic fluid and a concentrate prepared by that method and fluid prepared from that concentrate.

SUMMARY OF THE INVENTION

In accordance with this invention there is provided a method of preparing a high water based hydraulic fluid concentrate which forms a stablised microemulsion when diluted with water, the concentrate comprising as percentage weight of the concentrate:

(a) from 1 to 40%, preferably 2 to 15%, of a zincdihydrocarbyldithiophosphate (hereinafter referred to as ZDDP) of the general formula:

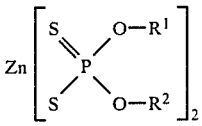

I where $R^1$ and $R^2$ are each independently the same or a different hydrocarbyl group;

(b) the reaction product of (i) from 0.3% to 20%, preferably 2 to 10%, of an alkanolamine of general formula:

$$H_{(3-m)}N(R^3OH)_m \qquad \text{II}$$

where m is 1, 2 or 3 and $R^3$ is an alkyl group, and (ii) from 1 to 15%, preferably 1 to 6%, of a phosphate ester acid of the general formula:

$$[R^4O(R^5O)_x\frac{}{n}\underset{\underset{O}{\|}}{P}\frac{}{}OH]_{(3-n)} \qquad \text{III}$$

where each n is independently 1 or 2, x is between 1 and 20, $R^4$ and $R^5$ are each independently is a hydrocarbyl group, said alkanolamine being in excess of the amount required to react with all of said phosphate ester acid; and (c) from 0 to 20%, preferably 5 to 15%, of a polyalkylene glycol having a molecular weight in the range 1000 to 100,000, Preferably the molecular ratio of said alkanolamine to said phosphate ester acid is in the range 3-n:1 to 4(3-n):1.

It is considered that the phosphate ester acid and the alkanolamine react to produce a compound of the general formula:

$$\left[[R^4O(R^5O)_x\frac{}{n}\underset{\underset{O}{\|}}{P}\frac{}{}OH]_{(3-n)}\right] \cdot [H_{(3-m)}N(ROH)_m]_{(3-n)} \qquad \text{IV}$$

where $R^3$, $R^4$ and $R^5$, and m and n, are as defined above.

An excess of the alkanolamine is desirable to stablise the ZDDP and also because it is in itself a useful corrosion inhibitor. Moreover, the benefit gained by using a fluid derived from a concentrate according to the present invention is considered to be at least in part as a result of the presence of said reaction product.

Preferably said alkanolamine is an ethanolamine, ideally triethanolamine.

Preferably $R^1$ and $R^2$ in Formula I above are each independently the same or a different alkyl group having a chain length from C2 to C10.

Preferably R4 in Formula III above is alkyl having a chain length of from C10 to C30, $R^5$ is ethylene and x is between 2 and 15.

Preferably said polyalkylene glycol is an ethylene oxide/propylene oxide copolymer.

To provide a stable concentrate it is necessary to disperse the ZDDP which is oil soluble in a water phase containing the reaction product of the alkanolamine and the phosphate ester acid.

To achieve this end the invention also provides a method of preparing a stable concentrate according to the invention which comprises the steps of (a) forming a first homogenous phase by dissolving ZDDP in a coupling agent;

(b) reacting the alkanolamine with the phosphate ester acid and forming a second homogenous phase by dissolving said reaction product in water and adding the polyalkylene glycol, if any; and, (c) mixing said first and second phases to produce a microemulsion.

Preferably said coupling agent, is an alkanol, for example n-hexanol.

Additional emulsifying agents may be required to assist in stabilising the concentrate. For instance a sodium petroleum sulphonate may be added to said first phase and an alkylene glycol, preferably hexylene glycol, and/or a polyoxyalkylene sorbitan monolaurate, preferably polyoxyethylene (20) sorbitan monolaurate, may be added to the second phase.

Additional corrosion inhibitors may also be added to improve the final performance of the fluid. For instance a benzotriazole, preferably dibutylaminobenzotriazole, may be added to the first phase while further alkanolamine, preferably monoethanolamine, may be added to the second phase.

The invention also provides a concentrate for a high water based hydraulic fluid prepared by a method according to the invention and then a high water based hydraulic fluid prepared from said concentrate which is diluted with approximately 95% of water.

Such a fluid has been found to offer favourable antiwear properties in tests conducted on the fluid. Preferably all the tests on such a fluid would be according to the well-known Vickers Vane pump test specified in the Institute of Petroleum's Standard Test No. 281. However, because such test is expensive to run, is lengthy and, even with modifications to reduce its severity by running at a pressure of only 56 Kg $cm^{-2}$ at 50° C., is difficult to obtain reproducible results, we have also performed a number of modified Four Ball Wear Tests according to the Institute of Petroleum's Standard Test No. 239. Our tests were run for only 15 minutes at various lever arm loads so as to reduce the effects of fluid evaporation which occurs if the test is run for longer periods and which of course defeats the purpose of the test.

While the Vickers Vane Pump test is considered presently to be the more representative screening test for a high water based hydraulic fluid, and indeed it is not considered that the results obtained in a Four Ball wear test are necessarily, if at all, comparable with those from a Vickers Vane Pump test, it is believed, however, that the Four Ball wear test does at least determine whether a fluid has sufficient antiwear character for it to be used as a high water based hydraulic fluid.

Nevertheless the test is not considered to give a representative indication of how well that fluid would perform in industrial applications.

Thus while our preferred embodiment of the present invention has been tested in the Vickers Vane Pump test, the numerous other Examples falling within the scope of the present invention have been tested in the Four Ball wear test.

These examples are described further hereinafter, although not all described fall within the scope of the invention. Some are provided for comparative purposes only. Each Example indicates the proportions of various components in a concentrate. The product tested is normally diluted with 95% water but where variations are made this is noted. The following components have been used, each being given a code to identify it, where present, in the individual Examples.

TABLE I

| Code | Component |
|---|---|
| A | All A codes are Zincdihydrocarbyldithiophosphates (ZDDP). Each code gives the $R^1$ and $R^2$ groups, according to formula I above, present in the ZDDP. It should be noted that some of the ZDDP's listed are chemical mixtures of more than one ZDDP and, as such, contain more than two different hydrocarbyl groups. |
| A1 | C4, C6 and three isomeric C8 alkyl groups. |
| A2 | C4 and C5 primary alkyl groups. |
| A3 | C8 trimethyl pentyl groups. |
| A4 | C4, C5, C6 and two isomeric C8 alkyl groups. |
| A5 | C3, C6 alkyl groups. |
| A6 | C6 dimethyl isobutyl carbinol group. |
| A7 | C8 2-ethyl hexyl group. |
| A8 | C8 2-ethyl hexyl group (different manufacturer to Code A7 above). |
| A9 | C4, C5, C6 and two isomeric C8 alkyl groups (different to Code A4 above). |
| A10 | Primary alkyl group. |
| A11 | C3 isopropyl and C6 dimethyl isobutyl carbinol groups. |
| A12 | C4 isobutyl and C5 amyl groups. |
| A13 | C8 iso-octyl group. |
| A14 | Not a ZDDP but a product sold under the trade description Anglamol 99, a sulphur phosphorous load carrying additive, sold by the Lubrizol Corporation. |
| B | All B codes are Alkanolamines as identified in each case. |
| B1 | Triethanolamine |
| B2 | Diethanolamine |
| B3 | Monoethanolamine |
| C | All C codes are phosphate ester acids. Each code gives the $R^4$ group, according to formula III above, and x where known. In each case $R^5$ is $CH_2CH_2$. |
| C1 | Tridecanyl group (C13 alkyl) x is approximately 3 |
| C2 | Tridecanyl group (C13 alkyl) x = 5 |
| C3 | Synthetic C12–C15 isomeric alkyl groups, x = 5 |
| C4 | Oleyl group (C18 alkyl with double bond), x = 5 |
| C5 | Tridecanyl group (C13 alkyl), x = 10 |
| C6 | Synthetic (C12–C15 isomeric alkyl groups, x = 10 |
| C7 | Oleyl group (C18 alkyl with double bond), x = 10 |
| D | All D codes are polyalkylene glycols as identified in each case. |
| D1 | An ethylene oxide/propylene oxide copolymer produced under the trade description AX 1495.01 by the Dow Corporation. |
| D2 | An ethylene oxide/propylene oxide copolymer produced under the trade description Breox 75-W-1800 by B.P. Chemicals Limited. |
| D3 | An ethylene oxide/propylene oxide copolymer produced under the trade description XAS 1675 by the Dow Corporation. |
| D4 | An ethylene oxide/propylene oxide copolymer having an ethylene oxide to propylene oxide content of 3:1 and a molecular weight between 3000 and 4000. |
| D5 | An ethylene oxide/propylene oxide copolymer produced under the trade description Glissolube H505 by the BASF Wyandotte Corporation. |
| E1 | Sodium Petroleum Sulphonate. |
| E2 | n-Hexanol |
| F1 | Dibutyl aminomethyl benzotriazole |
| G1 | Polyoxyethylene (20) sorbitan monolaurate |
| G2 | Hexylene glycol |
| H1 | Deionised water |

EXAMPLE I

A high water based hydraulic fluid concentrate was formed using the following components in the proportions indicated according to the codes established in Table I above.

| | | | |
|---|---|---|---|
| A1 | 10% | F1 | 0.5% |
| B1 | 6% | G1 | 4% |
| C1 | 4% | G2 | 5% |
| D1 | 10% | B3 | 3% |
| E1 | 10% | H1 | 41.5 |
| E2 | 6% | | |

The method of preparation comprised forming a first homogenous mixture by blending together components E1,A1,E2 and F1 above and in that order whilst maintaining the temperature below 50° C.

A second homogenous mixture was then prepared by reacting components B1 and C1 together for at least 5 minutes at about 70° C., adding the water (H1) and then component D1, with stirring, until all the polymer was dissolved, and then finally adding components G1,G2 and B3 in that order.

Whilst continuously stirring and maintaining the temperature below 40° C., the finished concentrate was completed by pouring the first homogenous mixture into the second.

When diluted with 95% of deionised water the resulting fluid had the following results in the Vickers Vane Pump test referred to above. These are compared in Table II below with the results of an existing fluid marketed by ourselves under the Trade Description K757.

The average duration of each test was in excess of 400 hours in the case of Example 1 while being only just above 100 hours in the case of the prior art. Moreover, the average wear rate in terms of the weight lost from the pump parts during each test was, in the case of Example 1, about 18 mg per hour while in the case of the prior art fluid, was in excess of 25 mg per hour.

TABLE II

| | EXAMPLE I | | | K.757 | | |
|---|---|---|---|---|---|---|
| TEST NO. | DURATION OF TEST (HOURS) | TOTAL WEIGHT LOSS (g) | WEAR RATE (mg/Hr) | DURATION OF TEST (HOURS) | TOTAL WEIGHT LOSS (g) | WEAR RATE (mg/Hr) |
| 1 | 250 | 8.0 | 32 | 203 | 3.1 | 15 |
| 2 | 530 | 8.2 | 15 | 45 | 1.7 | 38 |
| 3 | 350 | 7.3 | 21 | 51 | 1.9 | 37 |
| 4 | 230 | 4.7 | 20 | 17 | 0.5 | 33 |
| 5 | 430 | 5.6 | 13 | 130 | 3.9 | 30 |
| 6 | 500 | 7.4 | 15 | 90 | 2.6 | 29 |
| 7 | 670 | 12.5 | 19 | 71 | 2.4 | 34 |
| 8 | — | — | — | 80 | 2.9 | 36 |
| 9 | — | — | — | 250 | 6.4 | 25 |
| 10 | — | — | — | 80 | 2.6 | 32 |
| 11 | — | — | — | 250 | 5.2 | 21 |

These improved results are considered to be due to the combination of the ZDDP (A) with the reaction product of the alkanolamine (B) and the phosphate ester acid (C).

EXAMPLES I*a* TO I*f*

In these examples the concentrate of example I above has been diluted with 95% (Example I*a*), 90% (Example I*b*) and 80% (Example I*c*) of deionised water respectively and the prior art concentrate K757 with 95% (Example I*d*), 90% (Example I*e*) and 80% (Example I*f*) of deionised water respectively. The resulting fluids were subjected to Four Ball wear tests of 15 minutes duration at various lever arm loads. The results obtained in these tests are given in Table III below.

TABLE III

| | Examples Ia to If | | | | | |
|---|---|---|---|---|---|---|
| | Example | | | | | |
| % solution in deionised water | Ia 5% | Ib 10% | Ic 20% | Id 5% | Ie 10% | If 20% |
| kg | | | | | | |
| 6 | 0.32 | 0.19 | 0.18 | 0.51 | 0.54 | 0.44 |
| 30 | 0.46 | 0.51 | 0.54 | 0.53 | 0.52 | 0.50 |
| 60 | 0.55 | 0.61 | 0.66 | 0.52 | 0.53 | 0.53 |
| 90 | 0.64 | 0.71 | 0.71 | 0.59 | 0.61 | 0.61 |
| 120 | 0.72 | 0.79 | weld | weld | weld | weld |
| 150 | weld | weld | — | — | — | — |

Table III gives the wear scar diameter in millimeters resulting on the test ball after 15 minutes test at lever arm loads indicated.

It is evident from these results that there is no appreciable difference between the prior art fluid represented by Examples I*d* to I*f* and the present Example (Examples I*a* to I*c*), in accordance with the invention at intermediate lever arm loads. Nevertheless the invention does show improvement both at low lever arm loads and at high lever arm loads. These results also show that, perhaps somewhat surprisingly, the better dilution of the concentrate according to the invention is with about 95% deionised water. More specific conclusions concerning this point are raised below but these results demonstrate that the precise dilution of the concentrate is not critical.

EXAMPLE 2 TO 7

In these examples the same components have been used as in Example I above and the concentrate and the 95% dilution thereof prepared in the same way. In each case however certain of the components have been removed as indicated in Table IV below which also records Four Ball wear test results where these have been established.

TABLE IV

| | Examples 2 to 7 | | | | | |
|---|---|---|---|---|---|---|
| Example | 2 | 3 | 4 | 5 | 6 | 7 |
| Component | | | | | | |
| H1 | 51.5% | 51.5% | 51.5% | 47.5% | 50.5% | 45.5% |
| D1 | Nil | 10% | 10% | 10% | 10% | 10% |
| A1 | 10% | Nil | 10% | 10% | 10% | 10% |
| B1 | 6% | 6% | Nil | Nil | Nil | 6% |
| C1 | 4% | 4% | Nil | 4% | 4% | Nil |
| B3 | 3% | 3% | 3% | 3% | Nil | 3% |
| Kg. | | | | | | |
| 6 | 0.36 | 0.30 | 0.59 | 0.26 | 0.38 | 0.28 |
| 30 | 0.46 | 0.47 | 0.62 | 0.44 | 0.50 | 0.52 |
| 60 | 0.55 | 0.63 | 0.61 | 0.53 | 0.60 | 0.60 |
| 90 | 0.61 | 0.84 | 0.63 | 0.63 | 0.66 | 0.62 |
| 120 | 0.70 | weld | 0.65 | 0.65 | 0.68 | 0.67 |
| 150 | weld | — | weld | weld | weld | weld |

All other components as Example I.

From Example 2 it will be noted that removal of the polymer (D1) did not significantly affect the wear results.

From Example 3, although not affecting the wear scar at low lever arm loads, absence of the ZDDP (A1) increased the wear at higher loads and brought about welding of the balls at a lower load.

From Example 4 it can be seen that removal of both the alkanolamine (B1) and the phosphate ester acid (C1) showed no effect at higher lever arm loads but at low lever arm loads increased the wear scar diameter.

Example 5 illustrates the effect of the removal of triethanolamine (B1) only and Example 6 the removal also of the monoethanolamine (B3). In the first case there was little loss of performance as the monoethanolamine evidently reacted with the phosphate ester acid in place of the triethanolamine. With monoethanolamine removed as well there was a reduction in performance. Moreover, the resulting concentrate was acidic leading to the break up of the ZDDP which is clearly an unacceptable situation.

Example 7 failed to produce any ill effect in the wear results through the absence of the phosphate ester acid (C1).

EXAMPLES 8 TO 14

In these examples the concentration of the polymer (D1) is altered at the expense of the water (H1) with other components remaining at the same level as Example 1. Not all Examples were tested in the Four Ball test.

TABLE V

| | Examples 8 to 12 | | | | |
|---|---|---|---|---|---|
| Example | 8 | 9 | 10 | 11 | 12 |
| Component | | | | | |
| H1 | 50.5% | 36.5% | 31.5% | 21.5% | 11.5% |
| D1 | 1% | 15% | 20% | 30% | 40% |
| kg. | | | | | |
| 6 | — | 0.33 | — | — | 0.47 |
| 30 | — | 0.46 | — | — | 0.45 |
| 60 | — | 0.55 | — | — | 0.54 |
| 90 | — | 0.61 | — | — | 0.62 |
| 120 | — | weld | — | — | 0.66 |
| 150 | — | — | — | — | 0.71 |

Other components as Example 1.

These results show that with excessively high concentration of polymer the test can be completed at the highest lever arm load. However with only the emulsifiers present in Example I the concentrates in Examples 9 to 12 had split into two phases after standing for a month and hence would be unsuitable for commercial use. Up to and beyond 20% polymer could be sustained in single phase in a concentrate by appropriate adjustment of the emulsifiers present. Nevertheless such action would increase the cost of the concentrate significantly without providing commensurate benefit to the resulting fluid and hence the present invention is restricted to a concentrate containing up to 20% polymer.

EXAMPLES 13 TO 17

In these Examples the ZDDP (A1) content of the concentrate according to Example 1 above was altered to note what effect this had on the resulting diluted fluid.

TABLE VI

| | Examples 13 to 17 | | | | | |
|---|---|---|---|---|---|---|
| Example | 13 | 14 | 15 | 16 | 17 | (1a) |
| Component | | | | | | |
| H1 | 50.5% | 46.5% | 31.5% | 14.5% | 2.5% | (41.5%) |
| A1 | 1% | 5% | 20% | 30% | 40% | (10%) |
| E1 | 10% | 10% | 10% | 15% | 18% | (10%) |
| B1 | 6% | 6% | 6% | 9% | 10% | (6%) |
| C1 | 4% | 4% | 4% | 6% | 7% | (4%) |
| E2 | 6% | 6% | 6% | 8% | 8% | (6%) |
| D1 | 10% | 10% | 10% | 5% | 2% | (10%) |
| Kg | | | | | | |
| 6 | 0.32 | 0.39 | 0.33 | 0.39 | 0.41 | (0.32) |
| 30 | 0.56 | 0.53 | 0.47 | 0.50 | 0.51 | (0.46) |
| 60 | 0.64 | 0.54 | 0.57 | 0.61 | 0.61 | (0.55) |
| 90 | 0.84 | 0.61 | 0.67 | 0.68 | 0.7 | (0.64) |
| 120 | Weld | 0.67 | 0.77 | 0.74 | Weld | (0.72) |
| 150 | | Weld | Weld | Weld | | (Weld) |

Other components as Example 1.

These results demonstrate that above 5–10% concentration of ZDDP (A1) in the concentrate there is no further improvement of the performance of the resulting fluids.

Since the ZDDP clearly provides protection at the higher lever arm loads (there is no benefit to be gained by addition of ZDDP at low lever arm loads) and that there is an optimum level of ZDDP, it is apparent for these reasons that increasing the concentration of the final fluid as was effected in Examples 1b and 1c above would not be expected to improve performance at high level arm loads. This is indeed borne out by the results obtained in connection with Examples 1b and 1c. Each of the above Examples remained stable in concentrate and dilute form and hence the invention is able to sustain a level of ZDDP between 1% and 40%.

EXAMPLE 18

In this Example the Sodium Petroleum Sulphonate present in Example 1 is removed leaving 51.5% of water (H1) and the other components in the same proportion. At lever arm loads of 6, 30, 60, 90, 120 and 150 Kg the resulting fluid produced wear scar diameters of 0.34, 0.47, 0.53, 0.64, 0.72 mm and weld respectively.

While these results demonstrate that the performance of the resulting fluid was not adversely affected in the Four Ball test, and hence its presence in the fluid is not essential to the working of the invention, the concentrate according to this Example separated into two phases within a month of preparation. Thus the sodium petroleum sulphonate or similar detergent/dispersant is essential to render the invention commercially acceptable.

EXAMPLES 19 TO 23

In these Examples the phosphate ester acid (C1) concentration is altered together with the alkanolamine (B1), other components remaining as Example 1.

TABLE VII

| | Examples 19 to 23 | | | | | |
|---|---|---|---|---|---|---|
| Example | 19 | 20 | 21 | 22 | 23 | (1a) |
| Component | | | | | | |
| H1 | 44.5% | 43.5% | 37.5% | 49% | 50/5% | (41.5%) |
| C1 | 1% | 2% | 8% | 1.5% | 0.4% | (4%) |
| B1 | 6% | 6% | 6% | 1% | 0.6% | (6%) |
| Kg | | | | | | |
| 6 | 0.32 | 0.31 | 0.36 | 0.47 | 0.55 | (0.32) |
| 30 | 0.51 | 0.47 | 0.46 | 0.51 | 0.60 | (0.46) |
| 60 | 0.55 | 0.55 | 0.56 | 0.55 | 0.58 | (0.55) |
| 90 | 0.62 | 0.62 | 0.65 | 0.70 | 0.63 | (0.64) |
| 120 | 0.66 | 0.80 | Weld | 0.93 | Weld | (0.72) |
| 150 | Weld | Weld | — | Weld | | (Weld) |

All other components as Example 1

Examples 19, 20, 1 and 21 show increasing proportions of the phosphate ester acid (C1) in the presence of an excess of the alkanolamine (B1). The wear test results remain static. In Examples 22 and 23 minor amounts of the acid and alkanolamine adversely affected wear results throughout the range of lever arm loads.

EXAMPLE 24

In this Example only the method of preparation of Example 1 was altered in that the monethanolamine (B3) was reacted with the phosphate ester acid (C1) in place of the triethanolamine (B1) which was added last.

At 6, 30, 60, 90 and 120 Kg lever arm loads the resulting fluid produced wear scars of 0.33, 0.45, 0.54, 0.61 mm and Weld respectively. This does not represent a significant departure from the results of Example 1 except perhaps the weld at 120 Kg.

EXAMPLES 25 TO 30

In these Examples various phosphate ester acids C2 to C7 replace that (C1) of Example 1, all other components and proportions thereof, remaining as Example 1.

TABLE VIII

| | Examples 25 to 30 | | | | | | |
|---|---|---|---|---|---|---|---|
| | Example | | | | | | |
| Component | 25 C2 | 26 C3 | 27 C4 | 28 C5 | 29 C6 | 30 C7 | (1a) (C1) |
| Kg | | | | | | | |
| 6 | 0.29 | 0.20 | 0.34 | 0.19 | 0.19 | 0.29 | (0.32) |
| 30 | 0.47 | 0.47 | 0.47 | 0.48 | 0.48 | 0.49 | (0.46) |
| 60 | 0.54 | 0.52 | 0.51 | 0.52 | 0.53 | 0.55 | (0.55) |
| 90 | 0.60 | 0.57 | 0.58 | 0.57 | 0.57 | 0.58 | (0.64) |
| 120 | 0.65 | 0.99 | 0.82 | 0.90 | 0.58 | 0.86 | (0.72) |
| 150 | Weld | Weld | Weld | Weld | 0.88 | 1.08 | (Weld) |

Variation of the phosphate ester acid used does not adversely affect the results, indeed some produce better wear scar measurements, with even a result being obtained at the 150 Kg lever arm load level in the case of Examples 29 and 30.

EXAMPLES 31 TO 43

In these Examples various ZDDP's A2 to A13 replace the ZDDP (A1) of Example 1, all other components and proportions remaining as per Example 1.

Not every Example was found to remain stable after a month and so some adjustment of the emulsifier system may be necessary to obtain a commercially acceptable product in each case.

TABLE IX

| | Examples 31 to 43 | | | | | |
|---|---|---|---|---|---|---|
| Example Component | 32 A3 | 33 A4 | 35 A6 | 37 A8 | 39 A10 | 43 A13 |
| Kg | | | | | | |
| 6 | 0.32 | 0.30 | 0.32 | 0.28 | 0.30 | 0.24 |
| 30 | 0.47 | 0.43 | 0.44 | 0.43 | 0.44 | 0.45 |
| 60 | 0.55 | 0.53 | 0.54 | 0.50 | 0.55 | 0.53 |
| 90 | 0.60 | 0.60 | 0.62 | 0.58 | 0.58 | 0.59 |
| 120 | 0.74 | 0.65 | 0.69 | 0.83 | 0.96 | 1.01 |
| 150 | Weld | Weld | 1.02 | Weld | Weld | Weld |

Examples 31 (A2), 34 (A5), 36 (A7), 38 (A9), 40 (A14), 41 (A11) and 42 (A12) are not further illustrated by test results because each produces very similar results to those reproduced in Table IX above.

EXAMPLES 44 TO 47

Various polymers D2 to D5 are used in these examples in place of polymer D1 of Example 1 with all other components and proportions remaining the same.

TABLE X

| | Examples 44 to 47 | | | | |
|---|---|---|---|---|---|
| Example Component | 44 D2 | 45 D3 | 46 D4 | 47 D5 | (1a) (D1) |
| Kg | | | | | |
| 6 | 0.26 | 0.21 | 0.29 | 0.26 | (0.32) |
| 30 | 0.43 | 0.44 | 0.44 | 0.44 | (0.46) |
| 60 | 0.54 | 0.53 | 0.54 | 0.53 | (0.55) |
| 90 | 0.61 | 0.59 | 0.61 | 0.62 | (0.64) |
| 120 | 0.64 | 1.01 | 1.69 | 1.02 | (0.72) |
| 150 | Weld | Weld | Weld | Weld | (Weld) |

As evidenced by these results variation of the polymer does not affect the performance of the resulting fluid to any significant extent.

EXAMPLE 48

In this Example the triethanolamine B1 is replaced by diethanolamine (B2), all other components and proportions remaining as per Example 1. At 6, 30, 60, 90, 120 and 150 Kg lever arm loads the resulting fluid produced wear scar measurements of 0.27, 0.43, 0.54, 0.59, 0.94 mm, and Weld respectively in the Four Ball Tests performed on that fluid.

EXAMPLE 49

As has already been mentioned the Four Ball Wear Test is not entirely satisfactory as an indication of a fluid's ability to perform (a) in a Vickers Vane Pump Test or (b) in industrial hydraulic fluid applications. Using pure water however, as in the present Example, it is evident that the test is indicative to a limited extent of a fluids potential to perform in such situations. At 6 and 30 Kg lever arm loads pure water produced a wear scar diameter of 0.64 mm and weld respectively.

EXAMPLE 50

Finally a presently favoured composition includes a minor amount of an extreme pressure additive such as for instance certain chlorinated long chain paraffinic hydrocarbons which are found to emulsify quite readily. A composition as Example I above was prepared but in which there was only 8% ZDDP (A1) made up with 2% Cereclor 50 LV produced and sold by Imperial Chemical Industries Limited and which has a 50% Chlorine content. A chlorine content of from 40 to 70% has been estimated as suitable proportions for this application. The concentrate so produced and subsequent dilution were found to be quite stable. The chlorinated paraffin is included in the first homogenous mixture referred to above with reference to Example I. A dilution of this example was found to exhibit favourable antiwear properties in appropriate tests.

I claim:

1. A method of preparing a concentrate for a high water based hydraulic fluid, which method comprises the steps of:

(a) forming a first homogenous phase by dissolving in a coupling agent from 1 to 40% by weight of the final concentrate of a zincdihydrocarbyldithiophosphate (hereinafter referred to as ZDDP) of the general formula:

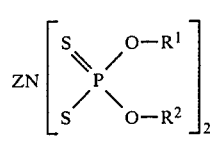

I where $R^1$ and $R^2$ are each independently the same or a different hydrocarbyl group;

(b) forming a reaction product by reacting:

(i) from 0.3% to 20% by weight of the final concentrate of an alkanolamine of the general formula:

$$H_{(3-m)}N(R^3OH)_m \qquad \text{II}$$

where m is 1, 2 or 3 and $R^3$ is an alkyl group, with (ii) from 1 to 15% by weight of the final concentrate of a phosphate ester acid of the general formula:

$$[R^4O(R^5O)_x\underset{\underset{O}{\|}}{P}OH]_{(3-n)} \qquad \text{III}$$

where n is 1 or 2, x is between 1 and 20, and $R^4$ and $R^5$ are each independently a hydrocarbyl group, provided always that said alkanolamine is in excess of the amount required to react with all of said phosphate ester acid;

(c) forming a second homogenous phase by dissolving said reaction product in water and adding from 0 to 20% by weight of the final concentrate of a polyalkylene glycol having a molecular weight in the range 1,000 to 100,000; and (d) mixing said first and second phases to produce a microemulsion.

2. A method according to claim 1 in which said coupling agent is an alkanol.

3. A method according to claim 2 in which said alkanol is n-hexanol.

4. A method as claimed in claim 1 in which sodium petroleum sulphonate or like emulsifier is added to said first phase prior to mixing said first and second phases.

5. A method as claimed in claim 1 in which a solubiliser is added to said second phase prior to mixing said first and second phases.

6. A method according to claim 5 in which said solubiliser comprises an alkylene glycol.

7. A method according to claim 6 in which said alkylene glycol is hexylene glycol.

8. A method as claimed in claim 5 in which said solubiliser comprises a polyoxyethylene sorbitan monolaurate.

9. A method according to claim 1 wherein, as percentage weight of the concentrate, (a) said ZDDP is present in said first phase in an amount from 2 to 15%;

(b) in said second phase the reaction product is the result of reacting:

(i) from 2 to 10% of said alkanolamine, and (ii) from 1 to 6% of said phosphate ester acid; and, (c) in said second phase said polyalkylene glycol is added in an amount from 5 to 15%.

10. A method according to claim 1 in which the molecular ratio of said alkanolamine to said phosphate ester acid is in the range (3-n):1 to 4(3-n):1.

11. A method as claimed in claim 1 in which $R^4$ is an alkyl group having a chain length from C10 to C30, $R^5$ is ethylene and x is between 2 and 15.

12. A method as claimed in claim 1 in which said alkanolamine is an ethanolamine.

13. A method according to claim 12 in which said ethanolamine is triethanolamine.

14. A method as claimed in claim 1 in which $R^1$ and $R^2$ in Formula I are each independently the same or a different alkyl group having a chain length from C2 to C10.

15. A method as claimed in claim 1 in which said polyalkylene glycol is an ethylene oxide/propylene oxide copolymer.

16. A concentrate for a high water based hydraulic fluid when prepared by a method as claimed in claim 1.

17. A high water based hydraulic fluid comprises a concentrate as claimed in claim 16 and between 70 and 97% by weight of the final fluid of water.

* * * * *